United States Patent [19]

Nathanson

[11] 3,937,947

[45] Feb. 10, 1976

[54] DISK SWITCH LIGHT

[76] Inventor: Albert Nathanson, 75-60 199th St., Flushing, N.Y. 11366

[22] Filed: Aug. 12, 1974

[21] Appl. No.: 496,460

[52] U.S. Cl. ..... 240/10.1; 240/24

[51] Int. Cl.[2] ..... F21S 1/12; F21P 3/00

[58] Field of Search ..... 240/10.1, 10.66, 10.68, 240/10 R, 22, 23, 24, 49, 2.1

[56] References Cited

UNITED STATES PATENTS

| | | | |
|---|---|---|---|
| 2,508,680 | 5/1950 | McLendon | 240/10.1 X |
| 2,630,480 | 3/1953 | Johnson et al. | 240/10.1 X |
| 3,261,973 | 7/1966 | Kell | 240/10.66 |
| 3,324,289 | 6/1967 | Cirko | 240/10.1 |

*Primary Examiner*—L. T. Hix
*Assistant Examiner*—E. M. O'Connor
*Attorney, Agent, or Firm*—Richard L. Miller

[57] ABSTRACT

A new design lamps in which two lamp bulbs are contained, and either only one or both lamps can be turned on, as wished; the lamp including a novel switch consisting of a pair of circular disks mounted on a rotatable cylinder from opposite ends of which the two lamp bulbs protrude, and each disk has radial extending contacts for selectively engaging a pair of stationary contacts on a base of the lamp housing.

3 Claims, 8 Drawing Figures

DISK SWITCH LIGHT

This invention relates generally to novelty lamps.

A principle object of the present invention is to provide a disk switch light in which manually rotatable disks can cause lighting up either one or both of a pair of lamp bulbs supported on a lamp.

Another object is to provide a disk switch light wherein, in one form of the invention, the lamp bulbs can selectively be either in a series or parallel circuit by rotating a novel disk switch unit that also controls whether one or both lamp bulbs are lighted.

Other objects are to provide a disk switch light which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
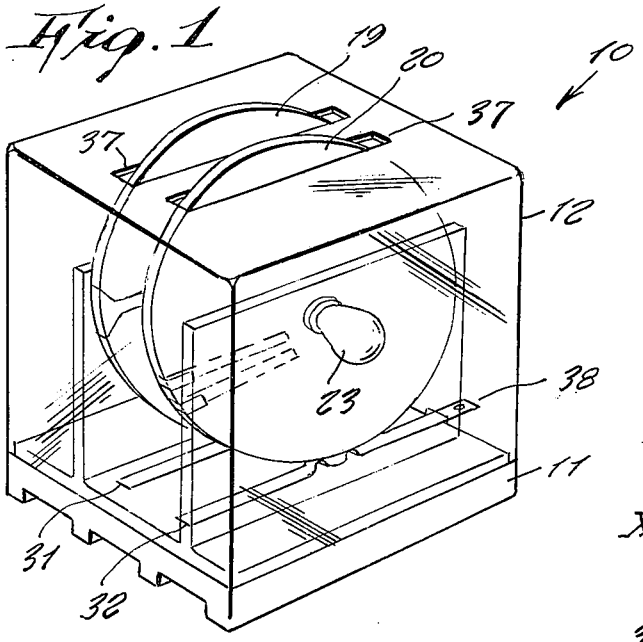
FIG. 1 is a perspective view of one form of the invention.

Referring now to the drawings in detail, and more particularly to FIGS. 1 to 4 thereof at this time, the reference numeral 10 represents a disk switch light according to the present invention wherein there is a base 11 over which there is placed an inverted, hollow, transparent dome 12 so to enclose a central chamber 13, thus formed, and which contains an electrical mechanism 14.

The mechanism 14 includes a rotatable disk switch 15 supported in bearing openings 16 of a pair of upstanding stanchions 17 integrally formed with the base 11. The disk switch 15 has a tubular, cylindrical hub 18 that fits into bearing openings 16, and around which a pair of axially spaced apart, circular disks 19 and 20 are secured by attachment means 21 so that the disks rotate together with the hub. Within both ends of the hub 18 a lamp socket is formed and lamps 22 and 23 are fitted thereinto.

A leaf contact 24 is secured by suitable adhesive means around a peripheral edge of the disk 19 and which is connected by wire conductor 25 to the lamp 22. Another pair of leaf contacts 26 and 27 are likewise secured around a peripheral edge of the disk 20. A conductor 28 connects leaf contact 26 to lamp 22, while a conductor 29 connects leaf contacts 27 to the lamp 23. The lamps are connected together by a conductor 30, as best shown in FIG. 2.

Upon the base 11, a pair of contacts leaf spring 31 and 32 are fixedly placed. The leaf spring 31 has a pair of upward, spaced apart bends that form contacts 33 and 34. The leaf spring 32 has likewise upward, equally spaced apart bends so to form contacts 35 and 36. Contacts 33 and 34 are engagable by contact 24, while contacts 35 and 36 are engagable by contacts 26 and 27 when the disk switch 15 is rotated. It is to be noted that the contacts 24 is wide enough so to engage both contacts 33 and 34 while at a same time the narrow contacts 26 and 27 each engage only one of the contacts 35 and 36, as clearly shown in FIG. 2.

Figure 2:
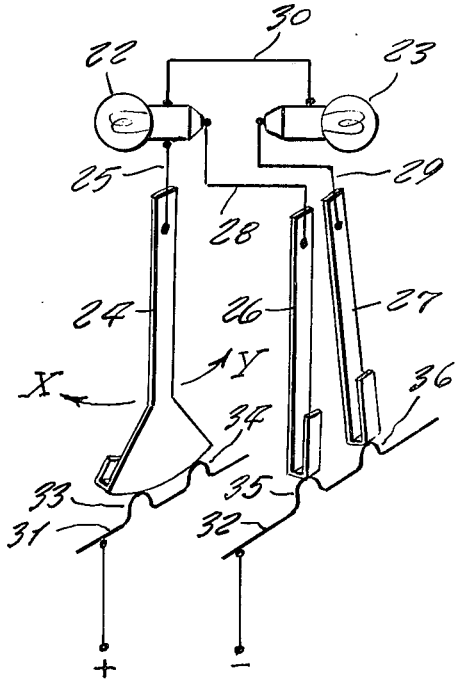
FIG. 2 is an electric diagram thereof.
Figure 3:
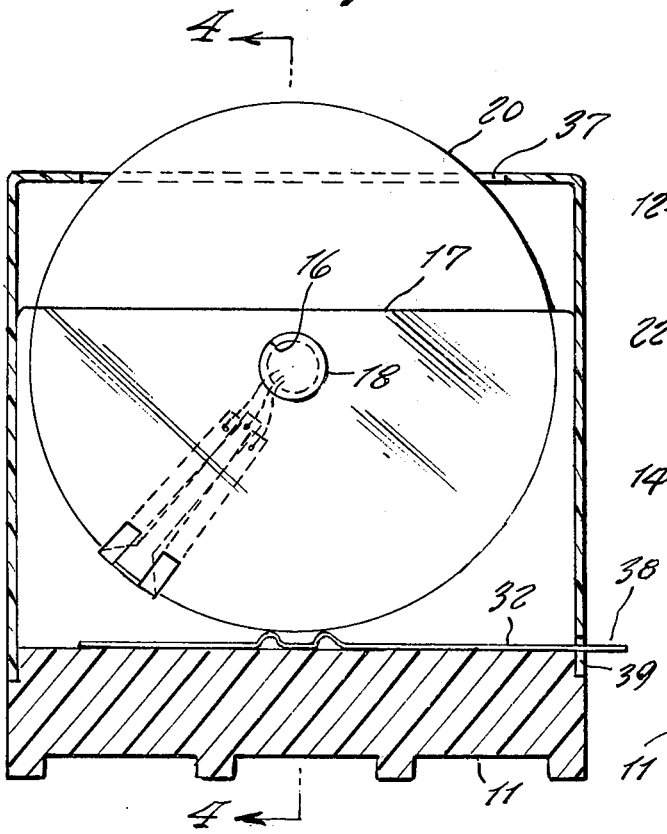
FIG. 3 is a cross sectional view on line 3—3 of FIG. 4.
Figure 4:
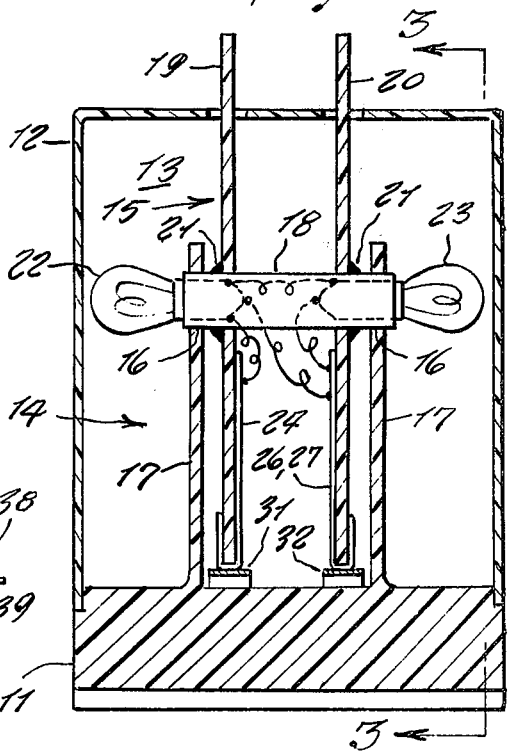
FIG. 4 is a cross sectional view on line 4—4 of FIG. 3.
Figure 5:
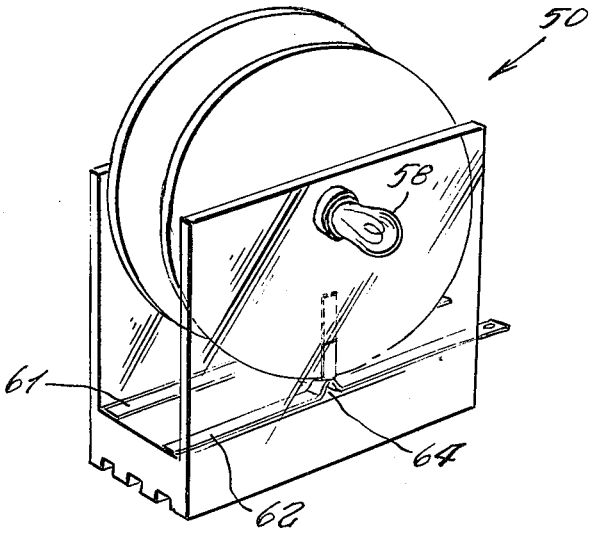
FIG. 5 is a perspective view of another form of the invention.
Figure 6:
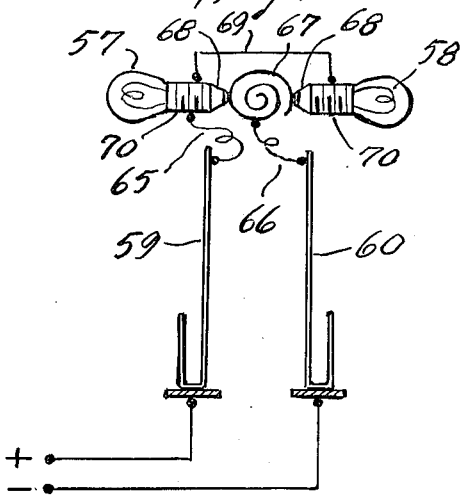
FIG. 6 is an electric diagram thereof.
Figure 7:
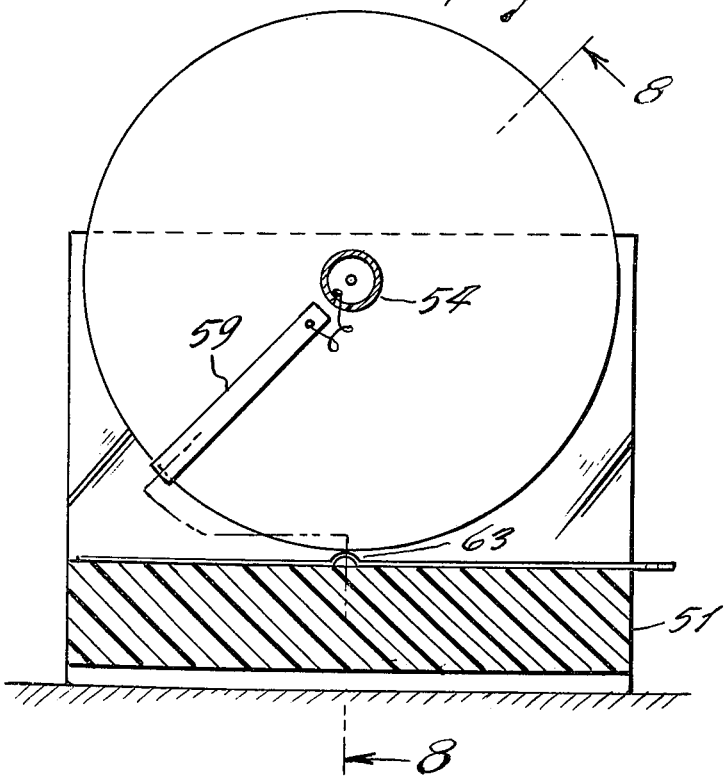
FIG. 7 is a cross sectional view on line 7—7 of FIG. 8.
Figure 8:
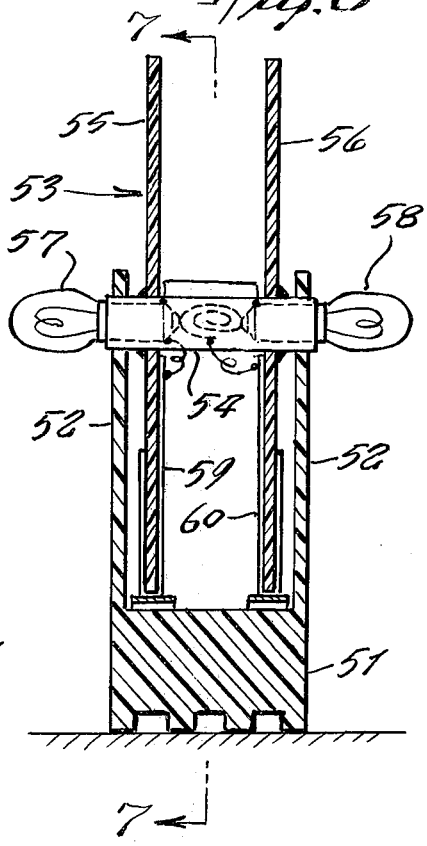
FIG. 8 is a cross sectional view on line 8—8 of FIG. 7.

Accordingly, it is now evident that when the disk switch 15 is rotated into the position for accomplishing the connection shown in FIG. 2, the both lamps are lighted in a parallel circuit. If the disk switch 15 is rotated slightly in a direction indicated by arrow X so that contacts 24 engages only contact 33, while contacts 27 engages contact 35, then only lamp 23 is lighted. However, if the disk switch is slightly rotated instead in a direction indicated by arrow Y, then the contact 24 engages only contact 34 while contacts 26 engages contact 36 so that only one lamp 22 is lighted. Further rotations in either directions X or Y causes both lamps to be shut off.

The dome 12 has a pair of slots 37 on top and through which the disks 19 and 20 protrude so that they may be manually rotated.

One end 38 of the leaf springs 31 and 32 extend outwardly through notch 39 from the chamber 13 in order to be connected to an electric power source.

The base 11, made of insultation material has a series of rib-like feet 40 on its underside for resting upon a supporting surface.

Reference is now made to FIGS. 5 through 8 wherein a modified design of disk switch light 50 includes base 51 having integral stanchions 52 that rotatably support disk switch 53 comprised of tubular hub 54 and disks 55 and 56 secured fixedly thereto, as above described. Lamps 57 and 58 are carried by the hub, as also above described.

A leaf contact 59 wraps around the peripheral edge of disk 55, while another leaf contact 60 wraps around the peripheral edge of disk 56. Leaf springs 61 and 62 are secured on the base 51 and each includes a single upward bend so to form contacts 63 and 64 respectively.

Contacts 59 is connected by wire conductor 65 to lamp 57, while contact 60 is connected by conductor 66 to a spiral spring 67 which is located between and connects together the tip terminals 68 of the lamps 57 and 58. Another conductor 69 connects together the side terminals 70 of the two lamps.

In operative use, it is now evident that when the disk switch 53 is rotated so that contact 59 engages contact 63 and the contact 60 engages contact 64, both lamps are lighted together, and when the disk switch is further rotated to disengage these contacts, then both lamps simultaneously go out.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a disk switch light, the combination of a base of electrical insulation material, said base having upstanding stanchions with bearing openings, a rotatable disc switch supported in said bearing openings, a pair of stationary leaf springs secured upon said base providing electric contact means, said rotatable disk siwtch carrying a pair of lamps and a plurality of leaf contacts engagable with said contact means for illumination of said lamps, said rotatable disk switch comprising a tubular, cylindrical hub having a lamp socket in each end fitted with said lamps, a pair of axially spaced apart circular disks affixed around said hub, said leaf contacts being connected to said lamps and being wrapped around the peripheral edges of said disks so to engage said stationary leaf springs of said base, and a transparent hollow dome being fitted upon said base enclosing said rotatable disk switch and stationary leaf springs, said dome including a top wall having a pair of slots therethrough, a portion of each said circular disk protruding upwardly therethrough for manual rotation thereof, and an end of each said stationary leaf spring extending sidewardly outward from under said dome for connection to a power source.

2. The combination as set forth in claim 1, wherein said base stationary leaf springs each has a pair of equally spaced apart, upward bends forming contacts, and a first of said disks has a wide singular said leaf contact for engaging both said contacts of one said base leaf spring while the second of said disks has a pair of narrow said leaf contacts for individually engaging both said contacts of the other said base leaf spring at a same time when said wide singular contact engages both said base leaf spring contacts; said wide singular contact being connected to one terminal of a first of said lamps, one of said narrow leaf contacts being connect to another terminal of said first lamp, another of said narrow leaf contacts being connected to one terminal of a second of said lamps, and another terminal of said second lamp being connected to said first stated terminal of said first lamp.

3. The combination as set forth in claim 1 wherein said base leaf springs each has a singular upward bend forming a contact, engagement between one said leaf contact and one said base leaf spring contact being at a same time when engagement is between the other said leaf contact and the other of said base leaf spring contact; one said leaf contact being connected to one terminal of a first said lamp, said terminal of said first lamp being also connected to one terminal of a second of said lamps, the other terminals of both said lamps being axially aligned with each other and connected together by a flat spiral spring held thereby therebetween, and the other said leaf contact being connected to said flat spiral spring.

* * * * *